US011702802B2

(12) United States Patent
Dong

(10) Patent No.: US 11,702,802 B2
(45) Date of Patent: Jul. 18, 2023

(54) TEMPERATURE CONTROL ELEMENT FOR ANTI-ICING THAT MATCHES HEAT LOSS CHARACTERISTICS OF ITEM BEING CONTROLLED

(71) Applicant: nVent Services GmbH, Schaffhausen (CH)

(72) Inventor: Wesley Dong, Belmont, CA (US)

(73) Assignee: nVent Services GmbH, Schaffhausen (CH)

( * ) Notice: Subject to any disclaimer, the term of this patent is extended or adjusted under 35 U.S.C. 154(b) by 1044 days.

(21) Appl. No.: 16/040,338

(22) Filed: Jul. 19, 2018

(65) Prior Publication Data

US 2019/0024325 A1 Jan. 24, 2019

Related U.S. Application Data

(60) Provisional application No. 62/534,578, filed on Jul. 19, 2017.

(51) Int. Cl.
*E01C 11/26* (2006.01)
*H05B 3/26* (2006.01)
(Continued)

(52) U.S. Cl.
CPC ..... *E01C 11/265* (2013.01); *E01C 9/083* (2013.01); *H05B 1/0227* (2013.01);
(Continued)

(58) Field of Classification Search
CPC ..... E01C 11/265; H05B 1/0227
(Continued)

(56) References Cited

U.S. PATENT DOCUMENTS 3,020,379 A 9/1959 Ludlow et al.
3,806,702 A 4/1974 Spencer
(Continued)

OTHER PUBLICATIONS

P. Maréchal, Y.P. Viala, J.J. Benayoun; Chemistry and rotational excitation of O2 in interstellar clouds; Astronomy and Astrophysics; 324, 221-236 (1997); 16 pages.
(Continued)

*Primary Examiner* — Tu B Hoang
*Assistant Examiner* — Thomas J Ward
(74) *Attorney, Agent, or Firm* — Quarles & Brady LLP

(57) ABSTRACT

A deicing system may include one or more walkway cassettes, a temperature control element, and a control unit. Each walkway cassette may include a casing and a heat tracing; cable in good thermal contact with the casing. The temperature control element may include a comparatively smaller casing and a heat tracing cable in good thermal contact with the casing, and may exhibit similar heat loss characteristics to the walkway cassettes. The temperature control element may include a temperature sensor on a top surface of its casing, which may generate temperature data and send the temperature data to the control unit. The control unit may provide power to the temperature control element and the walkway cassette(s) in parallel based on the temperature data. The temperature control element may be placed in proximity to the walkway cassette(s), and may be exposed to substantially the same environmental conditions as the walkway cassettes.

20 Claims, 9 Drawing Sheets

(51) Int. Cl.
*H05B 1/02* (2006.01)
*E01C 9/08* (2006.01)

(52) U.S. Cl.
CPC ..... *H05B 1/0252* (2013.01); *H05B 3/26* (2013.01); *H05B 2203/026* (2013.01); *H05B 2214/02* (2013.01)

(58) Field of Classification Search
USPC ..... 219/218
See application file for complete search history.

(56) References Cited

U.S. PATENT DOCUMENTS 3,813,630 A * 5/1974 Dalzell ..... H05B 1/0252 337/360
4,250,397 A 2/1981 Gray et al.
5,380,988 A 1/1995 Dyer
5,643,482 A 7/1997 Sandelman et al.
5,789,722 A * 8/1998 Zimmerman ..... G05D 23/22 219/205
5,900,178 A 5/1999 Johnsen
6,211,493 B1 4/2001 Bouman
6,215,102 B1 4/2001 Jones
6,278,085 B1 8/2001 Abukasm
6,438,909 B2 * 8/2002 Birch ..... E04F 11/00 52/177
6,870,139 B2 3/2005 Petrenko
6,909,074 B1 6/2005 Bradley
6,915,959 B2 7/2005 Jones
6,943,320 B1 9/2005 Bavett
7,183,524 B2 2/2007 Naylor et al.
8,076,619 B1 12/2011 Wingale
8,371,526 B2 2/2013 Shearer et al.
8,602,359 B2 12/2013 Stothers
2002/0117495 A1 8/2002 Kochman et al.
2007/0102243 A1 5/2007 Ruminski
2016/0377487 A1 12/2016 Cheung et al.
2017/0191228 A1 7/2017 Dong

OTHER PUBLICATIONS

Pentair; Raychem NGC-40 Advanced Heat-Tracing Control System; Product Overview; Copyright 2008-2016 Pentiar; 16 pages.
Pentair; Raychem NGC-30 Advanced Heat-Tracing Control System; Product Overview; Copyright 2001-2016 Pentair; 12 pages.
Pentair; Raychem 910 Series Single-Point Heat-Tracing Control System; Product Overview; Copyright 2001-2016 Pentair; 6 pages.

* cited by examiner

TEMPERATURE CONTROL ELEMENT FOR ANTI-ICING THAT MATCHES HEAT LOSS CHARACTERISTICS OF ITEM BEING CONTROLLED

RELATED APPLICATIONS

This application claims priority under 35 U.S.C. 119 to U.S. Provisional Patent Application No. 62/534,578 filed on Jun. 19, 2017, the entire contents of which are incorporated herein by reference.

BACKGROUND

In sub-freeing climates, snow and ice accumulation on surfaces can cause injury to persons and property, affecting all types of structures that are exposed to the environment. In particular, roadways, driveways, sidewalks, and roofs and gutters of buildings are at risk of damage and can harbor dangerous conditions when covered in snow or ice. Additionally, there is significant risk associated with working at certain worksites such as oil platforms and ships with exposed decks and passageways in freezing polar regions. Snow-melting and de-icing systems exist for applying heat to the snow and ice or to the covered surfaces, referred to herein as "heated surfaces," The thermal energy melts the snow and ice and eliminates the associated hazards.

Several devices for generating the necessary thermal energy exist. While the systems of the present disclosure may utilize some or all known heat-generating devices, they are particularly applicable to control of heat tracing cables. Heat tracing cables have one or more electrical conductors or conductor arrangements that generate heat along the cable length when an electrical current is applied to the conductor(s). The cables are connected to one or more controllers that manage power application to the cables. Typically, controllers include or communicate with environmental sensors that detect when snow or ice is present and, therefore, when heat is needed.

Present heat tracing systems for walkway de-icing rely on a precipitation sensor that senses a drop in resistivity between a set of electrodes as the snow falls and/or ice forms on a heated surface. These systems are maintenance-intensive because the galvanic exposure of the sensing electrodes degrades the electrodes, and because the electrodes become dirty and less effective at detecting precipitation.

Traditional snow sensing systems using precipitation sensors can measure the onset of snow conditions effectively, but these systems often cannot detect when heat is no longer needed. This is because the sensors operate based on the presence of moisture in contact or near the sensor itself. Even if snow or ice is inched from the immediate area around the sensor, it might still be present in other areas. Furthermore, with sonic types of presently used sensors, moisture will still be present in the form of water for a period of time, and the sensors will not "turn off", thereby wasting energy. As a result, present systems are often configured to operate the heaters for fixed durations based on conservative estimates of the energy needed for the "worst-case-scenario" snow or ice conditions. The alternative would be risking unsafe conditions in case of insufficient heat, but the drawback is that more energy than necessary is almost always used. A system that can detect when the snow or ice has been sufficiently melted is needed.

Finally, ice melting systems on uninsulated passageways on ships and oil platforms are very difficult to control with remote sensors. Unlike an insulated object, the overall heat transfer coefficient of an uninsulated surface of a walkway is highly dependent on local wind speed thereby creating significant variance along a single passageway depending on the particular surface's exposure to wind. The present disclosure provides snow and ice melting systems for uninsulated surfaces using local proxy temperature sensing systems having heat-loss characteristics that match those of the uninsulated surfaces to provide better temperature control.

SUMMARY

In accordance with an example embodiment, a deicing system may include a cassette and a temperature control element. The cassette may have heat loss characteristics, and may include a first casing and a first heat tracing cable. The first casing may have a top and an interior, the top having an interior surface facing the interior and an exterior surface that serves as a walking surface. The first heat tracing cable may be disposed in the interior and secured in good thermal contact with the interior surface of the first casing. The temperature control element may be disposed in proximity to the cassette, may be smaller than the cassette, and may have similar heat loss characteristics to the cassette. The temperature control element may include a second casing having a top surface, a temperature sensor exposed to the top surface of the second casing, and a second heat tracing cable disposed on a back side of the second casing and in good thermal contact with the second casing. The second heat tracing cable may be powered in parallel with the first heat tracing cable.

In another embodiment, the first and second casings may each include aluminum.

In another embodiment, the deicing system may include a control unit electrically coupled to the first and second heat tracing cables and the temperature sensor. The control unit may control signals applied to the first and second heat tracing cables based on temperature data generated by the temperature sensor.

In another embodiment, the control unit may be configured to detect, based on the temperature data, whether a temperature at the temperature sensor is above or below a predetermined threshold value, and, in response to detecting that the temperature is below the predetermined threshold value, may be configured to cause a first output signal to be applied to the first heat tracing cable and to cause a second output signal to be applied to the second heat tracing cable.

In another embodiment, the control unit may include a controller that receives and analyzes the temperature data, a controlled signal source that receives control signals from the controller and that, when activated, outputs an alternating current signal, and a splitter that receives the alternating current signal and that outputs the first output signal and the second output signal.

In another embodiment, the deicing system may include a second cassette having a third heat tracing cable. The third heat tracing cable may be powered in series with the first heat tracing cable, such that the first output signal being applied to first heat tracing cable causes both the first and third heat tracing cables to generate heat.

In another embodiment, the temperature control element may have a lower thermal mass than the cassette.

In accordance with an example embodiment, a temperature control element may include a casing having a top surface, a temperature sensor exposed to a top surface of the casing, the temperature sensor generating temperature data, and a first heat tracing cable disposed on a back side of the casing and in good thermal contact with the casing, the heat tracing cable being powered in parallel and with a second heat tracing cable of a heated walkway cassette. Electric power applied to the first and second heat tracing cables may be controlled based on the temperature data.

In another embodiment, the temperature sensor may send the temperature data to an external control unit. The first heat tracing cable may receive electric power from the control unit.

In another embodiment, the temperature control unit may have similar heat loss characteristics to the heated walkway cassette.

In another embodiment, the casing may be, smaller than a second casing of the heated walkway cassette and may have a lower thermal mass than the heated walkway cassette.

In another embodiment, the temperature sensor may be located substantially at a corner of the casing.

In accordance with an example embodiment, a heating system may include a walkway cassette having heat loss characteristics, and a temperature control element that is disposed in proximity to the walkway cassette, that is smaller than the walkway cassette, and that has similar heat loss characteristics to the walkway cassette. The walkway cassette may include a casing having a top and an interior, the top having an interior surface facing the interior and an exterior surface, and a first heat tracing cable disposed in the interior and secured in good thermal contact with the interior surface of the casing. The temperature control element may include a temperature sensor in contact with a top surface of the temperature control element that generates temperature data and a second heat tracing cable. The first and second heat tracing cables may receive power when the temperature data indicates that a temperature at a temperature at the top surface of the temperature control element is below a predefined threshold.

In another embodiment, the temperature control element may include a second casing. The second heat tracing, cable may be disposed on a back surface of the second casing, and in good thermal contact with the second casing.

In another embodiment, the first and second casings may each include aluminum.

In another embodiment, the heating system may include a control unit electrically coupled to the first and second heat tracing cables and to the temperature sensor. The control unit may receive the temperature data from the temperature sensor. The control unit may control the application of power to the first and second heat tracing cables based on the temperature data.

In another embodiment, the control unit may include a controller that receives and analyzes the temperature data, a controlled signal source that receives control signals from the controller and that, based on the control signals outputs an alternating current signal, and a splitter that receives the alternating current signal and that provides first and second output signals to the first and second heat tracing cables, respectively.

In another embodiment, the heating system may include a second walkway cassette having a third heat tracing cable. The third heat tracing cable may be powered in series with the first beat, tracing cable, such applying power to the first heat tracing cable causes both the first and third heat tracing cables to heat the first and second cassettes.

In another embodiment, the temperature control element may be arranged to be exposed to substantially similar environmental conditions as the walkway cassette.

In another embodiment, the first and second heat tracing cables may be powered in parallel.

DETAILED DESCRIPTION

Figure 1:
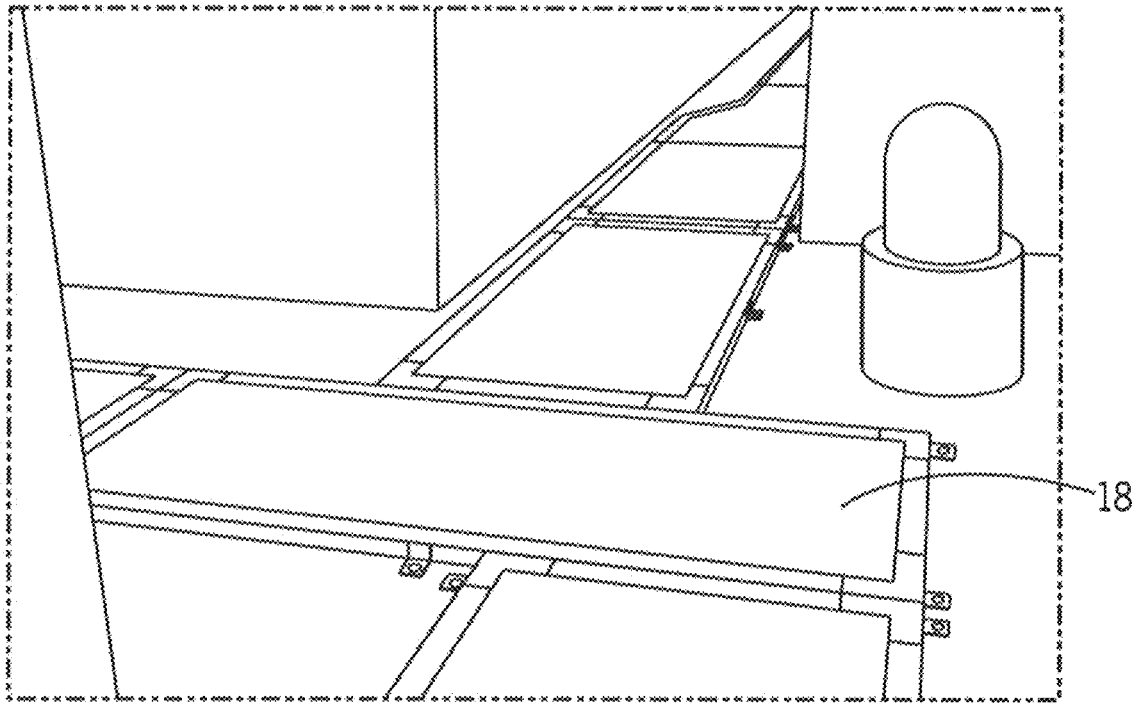
FIG. 1 is a perspective view of a series of heat traced walkway cassettes, at according to an embodiment.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to he read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

The present disclosure may be used in certain environments, such as a ship. In one non-limiting example, the ship contains a variety of uninsulated surfaces, such as, decks, walkways, stairs and handrails, or other surfaces throughout the ship that are generally exposed to the elements. On a ship, or oil platform, even under nominal wind conditions, there may be many different local "microclimates" that occur due to different areas of the ship being exposed to direct wind, while other areas of the ship are protected from the wind. For example, a ship might have a heat transfer coefficient of 80 $W/m^2 \cdot K$ on its windward exposed surfaces, and a heat transfer coefficient of 5 $W/m^2 \cdot K$ on its leeward side exposed surfaces. These microclimates may result in drastically different heat transfer characteristics for the various uninsulated surfaces. Therefore, it is often very difficult to control ice melting systems especially when the surfaces are uninsulated, only ambient temperature sensor is used as a basis for controlling the heat applied to the surfaces, and the temperature is controlled globally instead of locally. For example, if both the windward side and the leeward side of a ship are controlled from a single point controller, either one side will be excessively hot, or, alternatively, one side will not maintain the correct setpoint. Work environments such as a ship or an oil platform encounter extreme temperatures that quickly become hazardous when walkways and platforms are not adequately maintained free of ice and snow.

FIG. 1 shows a possible layout for a walkway formed by a plurality of heat traced walkway cassettes 18. The relatively portable size of the cassettes 18, measuring between about one and about three square meters in the non-limiting illustrated embodiments, allows for customized placement in existing walkways. This customization includes the ability to position the walkway cassettes 18 in a variety of different configurations, as shown in FIG, 1. In particular, the cassettes 18 may be placed in any suitable abutting configuration, forming a walkway with no gaps in between cassettes 18. For example, the cassettes 18 may be arranged so that all or a portion of at least one side of each cassette 1$ abuts an adjacent cassette 18. Cassettes 18 in a walkway may have uniform or varying dimensions, as well as a general shape that is uniform or varies. The exemplary walkway cassette 18 has a generally rectangular perimeter, but circular, trapezoidal, irregular, and other shapes are contemplated.

Figure 2:
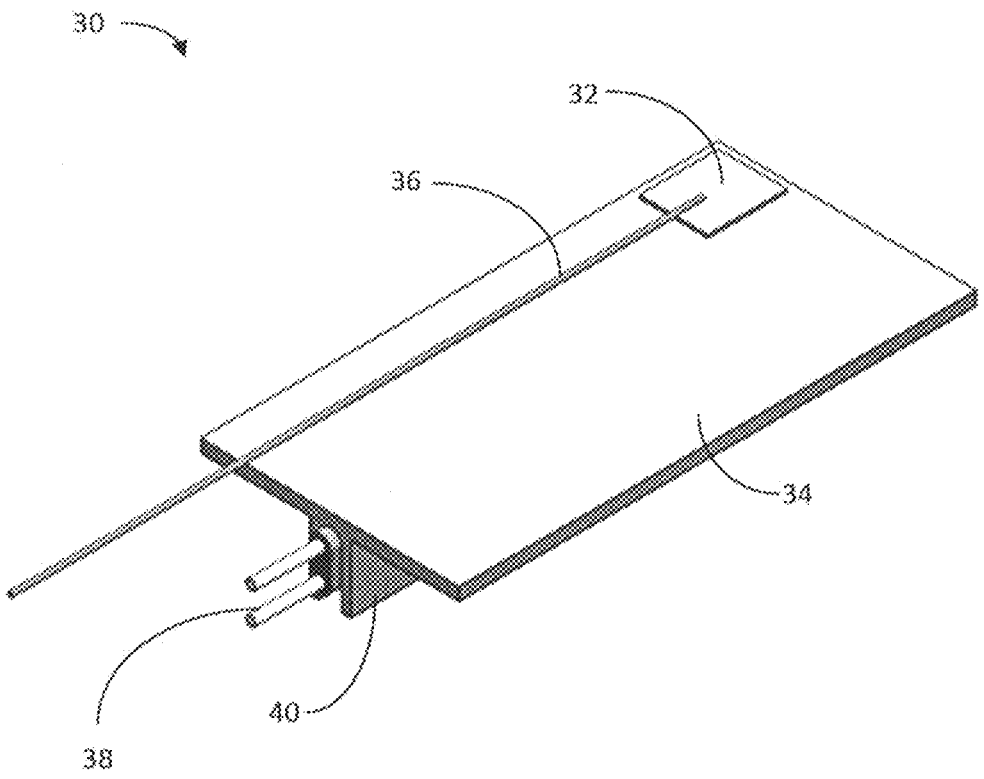
FIG. 2 is a perspective view of a temperature control element, according to an embodiment.

FIG. 2 shows a temperature control element 30 that may be used to sense temperature conditions for one or more cassettes (e.g., cassettes 18 shown in FIGS. 1 and 3-7) in a local area and to generate temperature data based on which the temperature of the cassettes may be adjusted. Temperature control element 30 may be mounted in the same general area as the cassettes being controlled (i.e., proximal to the cassettes) so that temperature control element 30 is exposed to the same temperature, wind, radiation, and precipitation conditions as these cassettes. Temperature control element 30 includes a sensor 32 mounted on a tap surface of a casing 34 that is communicatively coupled to external control circuitry through cable 36. Sensor 32 may be, for example, a thermistor, a resistance temperature detector (RTD), or a thermocouple. In some instances, sensor 32 may include more complex onboard circuitry such as an analog-to-digital convener (ADC). Casing 34 may be formed form a similar material as the casings of the cassettes that temperature control element 30 is being used to control, such as aluminum (e.g., extruded aluminum).

Temperature control element 30 is heated using one or more heat tracing cables 38 disposed on a back side of temperature control element 30, which may be powered in parallel with the heat tracing cables of the cassettes being controlled so that when power is applied to the heat tracing cables of the cassettes, it is also being applied to the heat tracing cables 38. Heat tracing cables 38 may be held in thermal contact with a back side of casing 34 using, for example, clips 40. However, it may be desirable to hold heat tracing cables 38 in place with the same mechanism used to hold the heat tracing cables of the cassettes being controlled in place for instances in which the cassette heat tracing cables are not held in place using clips. This advantageously ensures more closely matched heating/heat loss characteristics between temperature control element 30 and the cassettes.

Temperature control element 30 is designed and fabricated to have similar steady state heat loss characteristics and power density as the cassettes, but lower thermal mass. Specifically, steady state heat loss characteristics of the casing 34 of temperature control element 30 may be similar to those of the casing of the cassettes. The lower thermal mass of temperature control element 30 compared to that of the cassettes may be achieved by making temperature control element 30 (e.g., casing 34 of temperature control element 30) only a fraction (e.g., a proportional fraction) of the size of one of the cassettes 18 (e.g., a casing of one of the cassettes 18). By having a lower thermal mass than the cassettes 18, the temperature control element 30 as a comparatively lower heating time constant, meaning that the response of temperature control element 30 to changes in temperature is faster than that of the cassettes 18. This difference in response time reduces thermal ripple in the cassettes controlled by the temperature control element 30, so that tighter control about the nominal temperature setpoint is achieved. Heat tracing cables 38 may have the same cable diameter and cable type as heat tracing cable 24 used in walkway cassettes 18, but may have a different length such that the temperature control element 30 has the same density of meters of heat tracing cable per square meter of exposed surface area as walkway cassettes 18. Temperature control element 30 thereby exhibits a behavior when heated that approximates the behavior of a cassette 18 being heated, giving temperature control element 30 similar heat generation and heat loss characteristics as cassettes 18.

Sensor 32 may be placed at a corner of temperature control element 30 in order to account for edge effects that are also present in cassettes 18. In particular, the corners of the cassettes and the temperature control element 30 are the furthest from the heat tracing cables and are therefore likely to he the coldest areas. By sensing temperature at the (likely) coldest area of the top surface of casing 34 with sensor 32, temperature control element 30 avoids issues that would otherwise arise by sensing temperature at warmer areas of the top surface of casing 34. In particular, sensing temperature on or near areas of the top surface of casing 34 that overlap heat tracing cables 38 might result in cold spots on the temperature control element 30 and corresponding cold spots on the controlled cassettes being unaccounted for, which could undesirably lead to a buildup of snow or ice at those cold spots.

Figure 3:
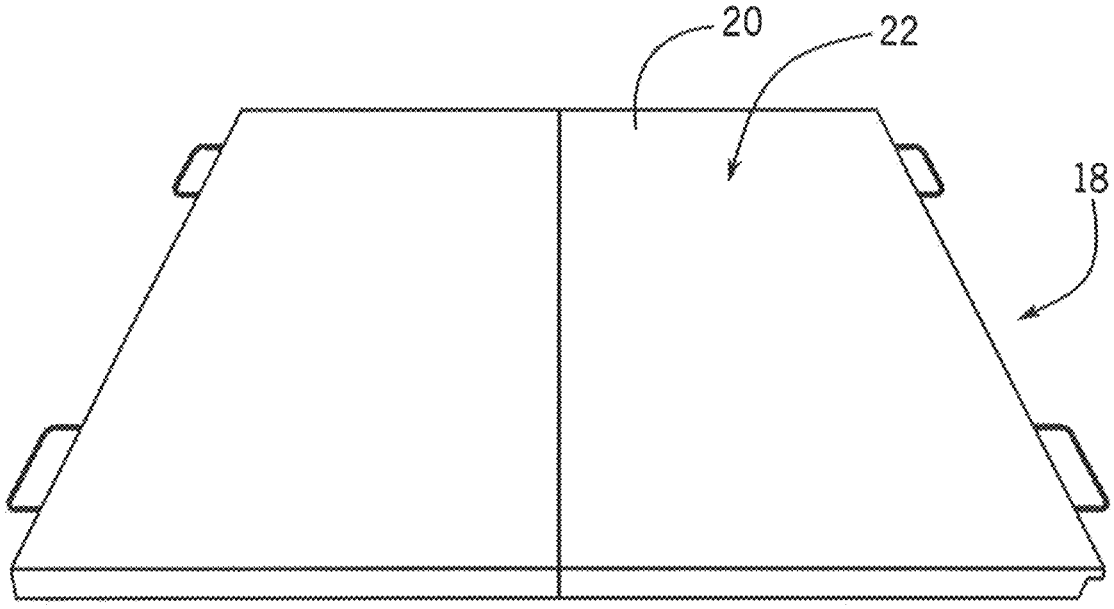
FIG. 3 is a perspective view of a heat traced walkway cassette, in accordance with the present disclosure.

In some embodiments, the heat traced walkway cassette 18 may include a formed panel or "casing" 20, typically, but not necessarily, made from formed sheet metal or an extruded profile, as shown in FIG. 3. The top side of the casing 20 of the cassette 18, which may serve as the walking surface, may include a textured surface 22 to provide additional non-slip qualities to the walkway cassette 18.

Figure 4:
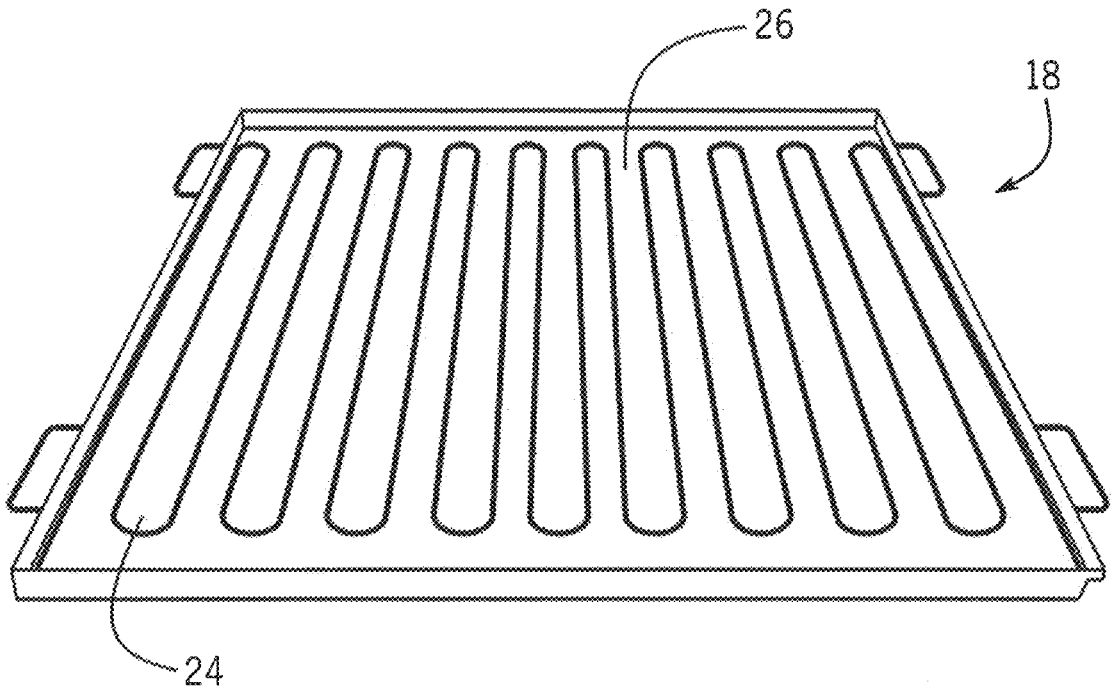
FIG. 4 is a perspective view of the underside of the heat traced walkway cassette of FIG. 3.
Figure 5:
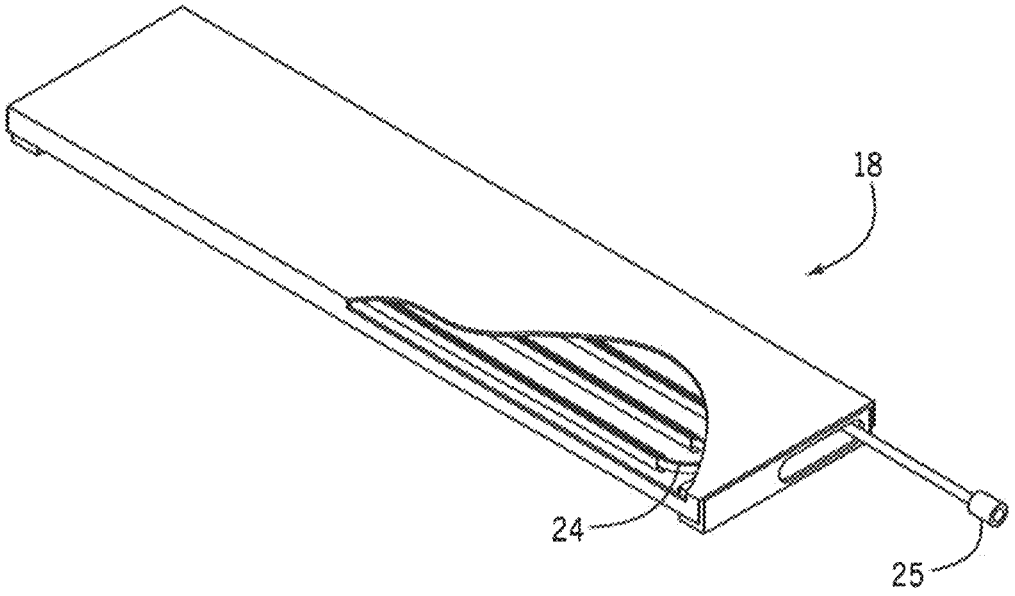
FIG. 5 is a top perspective view of an embodiment of a heat traced walkway cassette in accordance with the present disclosure, shown with a partial cutaway of the top of the cassette casing.
Figure 6:
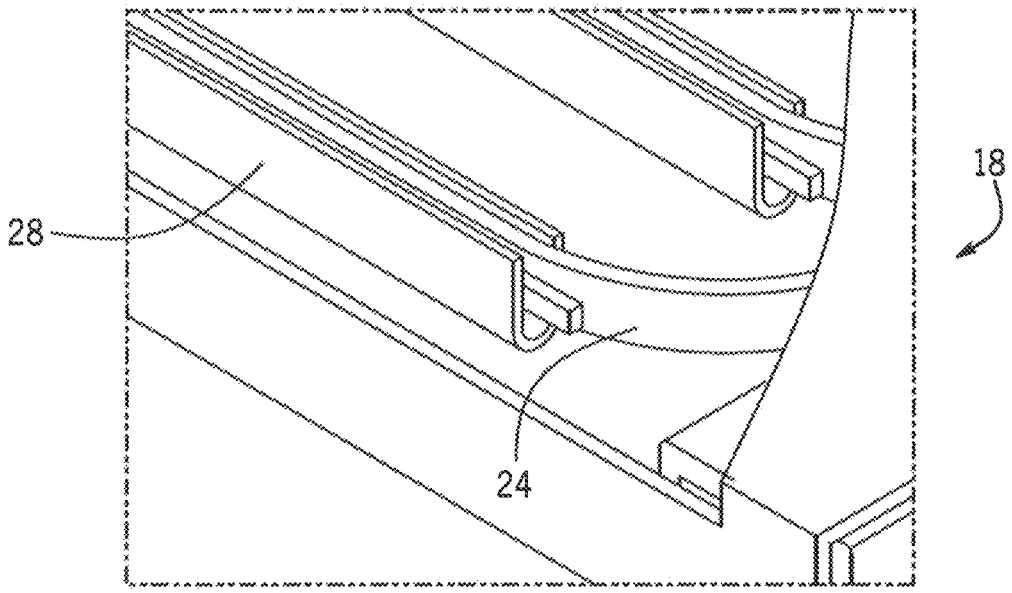
FIG. 6 is a partial close-up perspective view of the heat traced walkway cassette of FIG. 5, showing the partial cutaway of the top of the cassette casing.

Referring to FIGS. 4 and 5, heat tracing cable 24 may be installed in good thermal contact with the underside 26 of cassette 18 (e.g., the underside of casing 20 of cassette 18, which may be considered an interior surface of casing 20, said interior surface generally facing opposite to the exterior or "top" surface of casing 20). As used herein, "good thermal contact" refers to a connection between two bodies (e.g., direct physical contact, or a connection through a thermally conductive material interposed between the two bodies, such as thermal paste) that enables substantially efficient heat transfer between the two bodies (e.g., notwithstanding intrinsic thermal properties of the two bodies). Various positioning of the heat tracing cable 24 may be used, and may depend on the desired amount of heat transfer, cable properties such as heater type (e.g., self-regulating, constant wattage, hazardous environment rated, etc.), diameter and bend radius, type of power attachment, and size and material of the cassette 18. Power may be provided to heat tracing cable 24 via power input line 25, which may, receive alternating current (AC) signals controlled by controller circuitry coupled to cassette 18. In some instances, power input line 25 may instead be coupled to a cassette that is adjacent to cassette 18, such that multiple cassettes may be electrically connected in series where an AC signal applied at the heat tracing cable of a first cassette in the series will cause current to flow through the heat tracing cables of each of the cassettes in the series, thereby heating each of the cassettes in the series. It should be noted that power input line 25 may include multiple cables for conveying power to and from cassette 18.

In some embodiments, the heat tracing cable 24 may be fastened in place with tape. The tape may be any suitable adhesive tape, but advantageously may include properties that improve heat transfer from the tracing cable 24 to the cassette 18, such as a high thermal conductivity. In one embodiment, the tape may be aluminum tape that helps improve heat transfer and minimize temperature gradients. The aluminum tape may become part of the grounding scheme of the cassette 18, which may allow the use of unshielded heat tracing cable for the heat tracing cable 24. Other mechanisms for adhesively or non-adhesively securing the heat tracing cable 24 to the cassette 18 may be used. In one embodiment, shown in FIG. 6, the heat tracing cable 24 may be installed in a serpentine fashion in good thermal contact with the underside of the cassette 18 and fastened in place with dips 28. The heat tracing cable 38 of temperature control element 30 may be held in thermal contact casing 34 using adhesive or fastening mechanisms similar to those described above in connection with heat tracing cable 24 in order to ensure similar heat delivery properties between heat tracing cable 24 and, heat tracing cable 38.

The heat tracing cables 24 and 38 may be any suitable heater cables for heating a metal or other corrosion-resistant walkway casing in extreme environments. Thus, any heat tracing cables with known applications in underfloor heating may be used, provided such heat tracing cables are also weather-resistant. Similarly, heat tracing cables used in industrial heat tracing applications may be used, provided they have a suitable diameter, bend radius, and power requirements for use in the cassette 18 and temperature control element 30. As described above, heat tracing cables 24 and 38 may be unshielded when aluminum tape or another component grounds the cassette 18. Alternatively, the heat tracing cables 24 and 38 may be chosen from existing shielded heat tracing cables and may be self regulating (e.g. Raychem BTV, Raychem QTVR), constant wattage (e.g. Raychem XPI), or another suitable type of cable. Alternatively, in place of using a heat tracing cables 24 and 38 as the heating elements, pre-fabricated heating pads (e.g. silicone heating mat) may be used. Pre-fabricated heating pads may have some advantages over self regulating cable in that inrush currents are less, and heat generation is closer to the surface that requires heat, i.e. the top surface of the cassette 18 or of casing 34.

On a ship or platform, even in a nominal wind condition, there may be many local "microclimates," which may cause heat transfer from uninsulated surfaces to vary by an order of magnitude or more depending on a given surface's exposure to the wind. Simple temperature sensors like RTDs, thermocouples, thermistors and the like only report temperature. Without additional hardware, these temperature sensors cannot provide heat loss information that accounts for factors such as local wind, precipitation, and radiation conditions. In contrast, temperature control element 30 automatically accounts for local wind, precipitation and radiation conditions because temperature control element 30 is only used to control cassettes in a local area and is exposed to the same conditions that the cassettes are exposed to. Additionally, temperature control element 30 intrinsically approximates the steady state heat loss and power density characteristics of the cassettes being controlled, and therefore responds to these conditions in the same way that the cassettes respond. By using multiple temperature control elements 30 as a basis for temperature control across multiple zones with different microclimates, accurate temperature sensing and control can be achieved in each microclimate to a degree that is not generally possible with centralized temperature sensing and control arrangements. It should be noted that temperature control element 30 may have different power density characteristics compared to cassettes 18 if desired, but in such cases algorithms would need to be used to convert the temperature response of the sensor on temperature control element 30 to match the temperature response that would be observed at cassettes 18.

Figure 7:
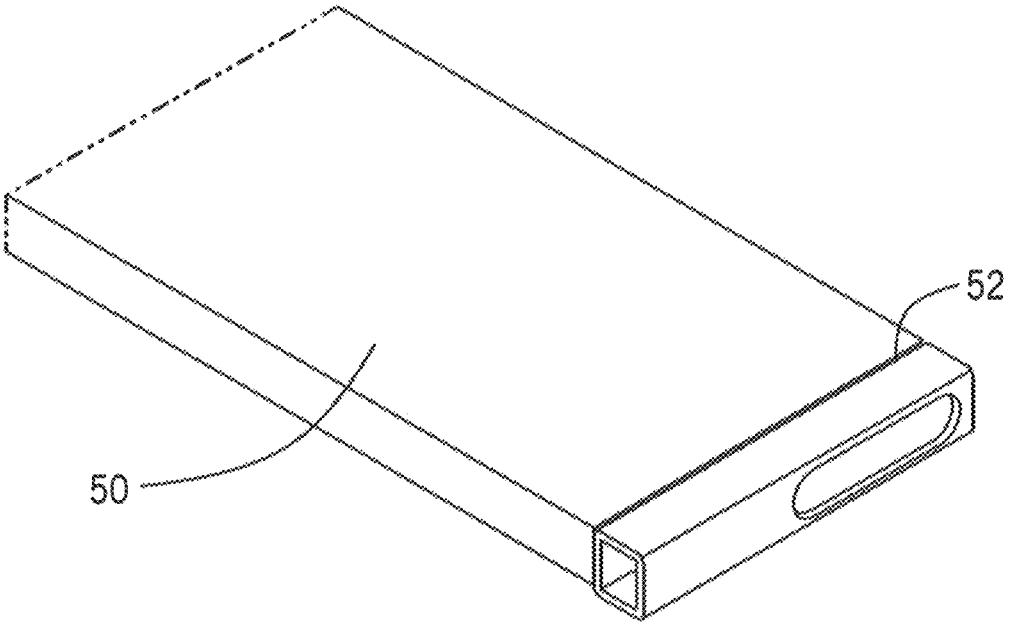
FIG. 7 is a partial close-up perspective view illustrating internal parts that may be included in the heat traced walkway cassette of FIG. 1 and 3-6 and in the temperature control element of FIG. 2.

Thermal insulation may be factory installed to thermally insulate the cassette from the deck surface of the ship or platform, as well as from weather. Referring to FIG. 7, an insulation sheet 50 (e.g. foam) may be added to thermally insulate the underside of either of the cassette 18 and the temperature control element 30. Structural standoffs 52 that may be built into the ends of the cassette 18 and the ends of the temperature control element 30, can also act to isolate the cassette 18 and the temperature control element 30 from the underlying steel deck of a ship or, in the case of temperature control element 30, from the selected mounting surface. The structural standoffs 52 may be, for example, made from a fiberglass material (e.g. a fiberglass tube), or any insulating material that is rigid enough such that the insulation sheet 50 is not damaged when users walk on the cassette 18. The structural standoffs 52 can be glued or bolted to the underlying steel decking of a ship in order to fasten cassette 18 or temperature control element 30 in place. By applying the same thermal insulation at the backside of temperature control element 30 as is applied to the backsides of walkway cassettes 18, the beat loss and heat generation characteristics of temperature control element 30 more accurately match those of walkway cassettes 18.

Figure 8:
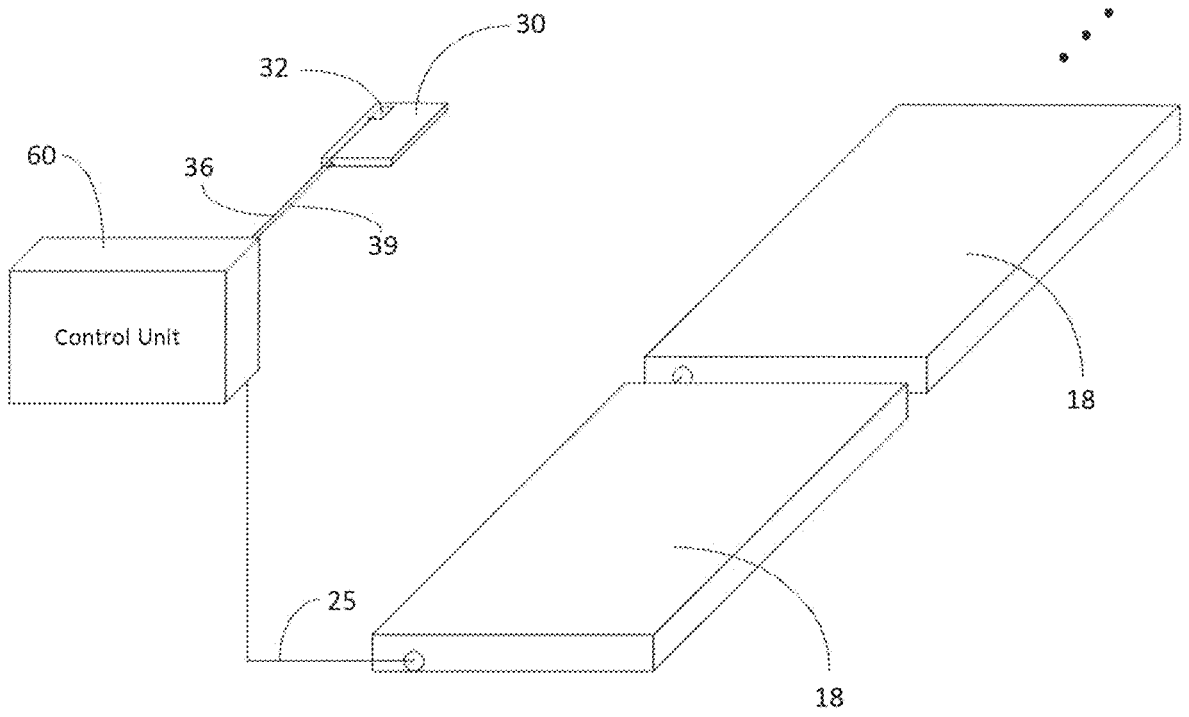
FIG. 8 is a perspective view illustrating a system that includes a control unit coupled to a temperature control element and heat traced walkway cassettes according to an embodiment.

FIG. 8 shows a perspective view of a system that illustrates a possible arrangement for the temperature control element 30 of FIG. 2 and the walkway cassettes 18 of FIGS. 1 and 3-7 with respect to a control unit. Control unit 60 is connected (e.g., electrically connected or electrically coupled) to walkway cassettes 18 via power input line 25, which provides power to the heat tracing cables of the walkway cassettes. Control unit 60 is also connected (e.g., electrically connected or electrically coupled) to temperature control element 30 via power input line 39, which provides power from control unit 60 to the heat tracing cables of the temperature control element 30. The sensor 32 on temperature control element 30 is connected to control unit 60 via cable 36. Temperature data sensed by sensor 32 may be transmitted across cable 36 to a controller of control unit 60. Control unit 60 may analyze the temperature data and may adjust the power (e.g., by adjusting the applied AC signal(s)) supplied to each of temperature control element 30 and cassette 18 based on the temperature data. For example, if the temperature data indicates that the temperature at the top surface of temperature control element 30 is below a predetermined threshold (e.g., which may be a default preset temperature setpoint or a temperature setpoint defined by a user, such as 3° C.), the controller of control unit 60 may begin applying power to the heat tracing cables of temperature control element 30 and to the heat tracing cables of cassette 18 (e.g., and to the heat tracing cables of other cassettes that may be coupled to control unit 60). In this way, the cassette 18 and the temperature control element 30 may be heated based on the temperature observed at the top surface of temperature control element 30, rather than based on ambient temperature (which may not reflect environmental conditions as accurately), without requiring temperature sensors being placed on walking surfaces of cassette 18 or any additional cassettes being controlled by control unit 60.

Control unit 60 may be disposed in dose proximity to both walkway cassettes 18 and to temperature control element 30 in order to reduce the lengths of cable 36, power input line 39, and power input line 25 in order to reduce losses associated with transmitting data and power along lengths of transmission line. Temperature control element 30 ma be disposed in dose proximity (e.g., within 5-10 meters) of one of walkway cassettes 1 that are controlled based on temperature data generated at temperature control element 30. The top surface of temperature control element 30 may be aligned along the same plane as or along a plane that is parallel to the plane along which the top surface of walkway cassettes 18 are aligned. In this way, temperature control element 30 is more likely to be exposed to similar environmental conditions as walkway cassettes 18 (e.g., with respect to wind exposure or snow accumulation present at the top surface of temperature control element 30). In some embodiments, temperature control element 30 may be placed near one or more of cassettes 18 and in the same orientation as cassettes 18 so as to experience (e.g., be exposed to) substantially the same environmental conditions as those cassettes.

Figure 9:
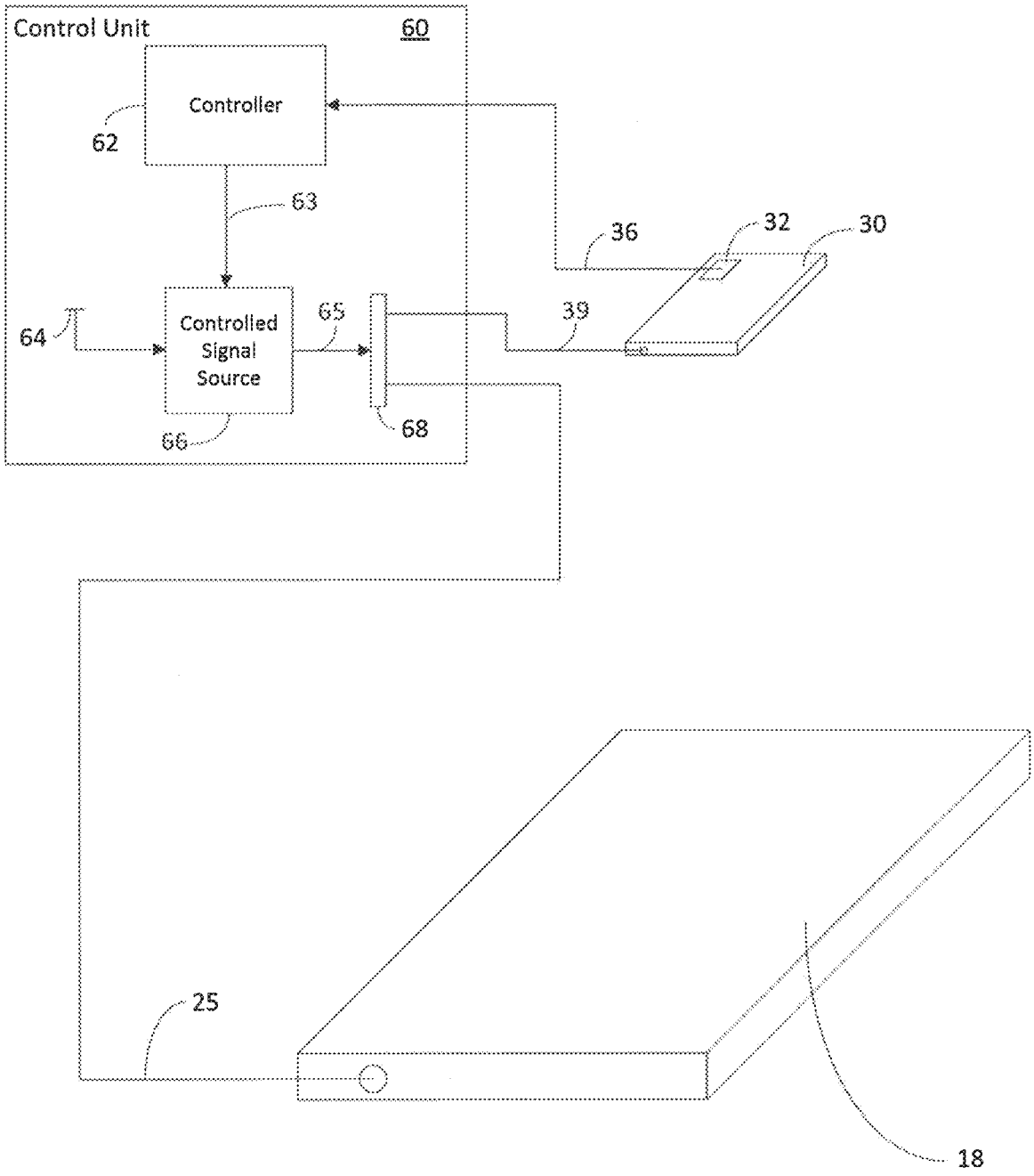
FIG. 9 is a block diagram illustrating detailed circuitry of the control unit of FIG. 8 and illustrating connections between the circuitry of the control unit and both a walkway cassette and a temperature control element according to an embodiment.

FIG. 9 shows a block diagram illustrating in greater detail some of the internal circuitry of the control unit 60 shown in FIG. 8, and the connections between this circuitry to walkway cassette 18 and to temperature control element 30. Control unit 60 includes a controller 62, a signal source 66 (e.g., which may be a controlled voltage source), and a power splitter 68. Controller 62 may be any temperature controller that can accept the output of sensor 32 as an input. Controller 62 may compare the temperature data produced by sensor 32 to a predetermined setpoint temperature (e.g., 2° C.). Controller 62 may control signal source 66 using control signals provided along control line 63 in response to determining that the temperature sensed by sensor 32 is less than the predetermined setpoint temperature. Signal source 66, when activated by controller 62, outputs an AC signal (e.g., which may be provided to signal source 66 by a power supply 64) to power splitter 65 via transmission line 65 that is coupled between signal source 66 and splitter 68. Power supply 64 may be contained within control unit 60 or, if desired, may represent an external power supply hat is coupled to control unit 60.

Splitter 68 split the AC signal output by signal source 66 between power input line 25 (coupled to heat tracing cable 24 of walkway cassette 18) and power input line 39 (coupled to heat tracing cable 38 of temperature control element 30) as respective first and second AC output signals. The first AC output signal applied to heat tracing cable 38 in temperature control element 30 generates (as a result of electric current passing through heat tracing cable 38) a total amount of heat at the top surface of temperature control element 30 that is proportional to the total amount of heat generated at the top surface of walkway cassette 18 when the second AC output signal is applied to heat tracing cable 24 in walkway cassette 18. This proportionality between heat generated at walkway cassette 18 and heat generated at temperature control element 30 is based on the difference in size between walkway cassette 1$ and temperature control element 30. For example, temperature control element 30 is smaller than walkway cassette 18 and, during heating operations, less overall heat, is generated at temperature control element 30 compared to the overall heat generated at walkway cassette 18 (however the heat density generated at both devices should be equal).

It should be noted that tuning may need to be performed on various characteristics of temperature control element 30 in order to sufficiently match the heat loss and heat generation characteristics of walkway cassettes 18. For example, the insulation, heat tracing cable, material characteristics, or sensor of temperature control element 30 may need to be tuned or optimized to account for edge effects (e.g., that result in higher heat loss per unit area for temperature control element 30 compared to walkway cassettes 18) for better heat characteristic matching to walkway cassettes 18. Edge effects refer to temperature non-linearities that occur at the edges of walkway cassettes 18 and of temperature control element 30, but that are more prominent in temperature control element 30 due to more of the surface area of temperature control element 30 being, proximal to an edge. If these edge effects are not compensated for, the sensor of temperature control element 30 may overestimate heat loss and the cassettes 18 may run at higher than the desired temperature.

In the present disclosure a number of example embodiments are presented with, reference to a walkway cassette. It will be appreciated, however, that the integrated control, temperature sensing, and power switching configurations disclosed herein may be applicable and incorporated into other types of exposed uninsulated surfaces, such as decks, stairs, handrails, and the like.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. Various features and advantages of the invention are set forth in the following claims.

What is claimed is:

1. A deicing system comprising:

a cassette having heat loss characteristics, the cassette comprising:

a first casing having a top and an interior, the top having an interior surface facing the interior and an exterior surface that serves as a walking surface; and a first heat tracing cable disposed in the interior and secured in good thermal contact with the interior surface of the first casing;

a temperature control element that is disposed in proximity to the cassette, that is smaller than the cassette, and that has similar heat loss characteristics to the cassette, the temperature control element comprising:

a second casing having a top surface and a back side opposite the top surface;

a temperature sensor disposed on the top surface of the second casing; and a second heat tracing cable disposed on the back side of the second casing and in good thermal contact with the second casing that is powered in parallel with the first heat tracing cable.

2. The deicing system of claim 1, wherein the first and second casings each comprise aluminum.

3. The deicing system of claim 1, comprising:

a control unit electrically coupled to the first and second heat tracing cables and the temperature sensor, wherein the control unit controls signals applied to the first and second heat tracing cables based on temperature data generated by the temperature sensor.

4. The deicing system of claim 3, wherein the control unit is configured to detect, based on the temperature data, whether a temperature at the temperature sensor is above or below a predetermined threshold value, and, in response to detecting that the temperature is below the predetermined threshold value, is configured to cause a first output signal to be applied to the first heat tracing cable and to cause a second output signal to be applied to the second heat tracing cable.

5. The deicing system of claim 4, wherein the control unit comprises:

a controller that receives and analyzes the temperature data;

a controlled signal source that receives control signals from the controller and that, when activated, outputs an alternating current signal;

a splitter that receives for alternating current signal and that outputs the first output signal and the second output signal.

6. The deicing system of claim 5, further comprising:

a second cassette having a third heat tracing cable, where in the third heat tracing cable is powered in series with the first heat tracing cable, such that the first output signal being applied to first heat tracing cable causes both the first and third heat tracing cables to generate heat.

7. The deicing system of claim 1, wherein the temperature control element has a lower thermal mass than the cassette.

8. A temperature control element, comprising:

a casing having a top surface and a back side opposite the top surface;

a temperature sensor disposed on a top surface of the casing, the temperature sensor generating temperature data; and a first heat tracing cable disposed on the back side of the casing and in good thermal contact with the casing, the first heat tracing cable being powered in parallel with a second heat tracing cable of a heated walkway cassette, wherein electric power applied to the first and second heat tracing cables is controlled based on the temperature data.

9. The temperature control element of claim 8, wherein the temperature sensor sends the temperature data to an external control unit, and wherein the first heat tracing cable receives electric power from the control unit.

10. The temperature control element of claim 8, wherein the temperature control element has similar heat toss characteristics to the heated walkway cassette.

11. The temperature element of claim 8, wherein the casing is smaller than a second casing of the heated walkway cassette and has a lower thermal mass than the second casing.

12. The temperature control element of claim 8, wherein the temperature sensor is located substantially at a corner of the casing.

13. A heating system comprising:

a walkway cassette having heat loss characteristics, the walkway cassette comprising:

a casing having a top and an interior, the top having an interior surface facing the interior and an exterior surface; and a first heat tracing cable disposed in the interior and secured in good thermal contact with the interior surface of the casing;

a temperature control element that is disposed in proximity to the walkway cassette, that is smaller than the walkway cassette, and that has similar heat loss characteristics to the walkway cassette, the temperature control element comprising:

a temperature sensor disposed on a top surface of the temperature control element that generates temperature data; and a second heat tracing cable, wherein the first and second heat tracing cables receive power when the temperature data indicates that a temperature at the top surface of the temperature control element is below a predefined threshold.

14. The heating system of claim 13, wherein the temperature control element comprises:

a second casing, wherein the second casing has a lower thermal mass than the casing of the walkway cassette, wherein the second heat tracing cable is disposed on a back surface of the second casing and in good thermal contact with the second casing.

15. The heating system of claim 14, wherein the casing and the second casing each comprise aluminum.

16. The heating system of claim 13, further comprising:

a control unit electrically coupled to the first and second heat tracing cables and to the temperature sensor, wherein the control unit receives the temperature data from the temperature sensor, and wherein the control unit controls the application of signals to the first and second heat tracing cables based on the temperature data.

17. The heating system of claim 16, wherein the control unit comprises:

a controller that receives and analyzes the temperature data;

a controlled signal source that receives control signals from the controller and that, based on the control signals, outputs an alternating current signal;

a splitter that receives the alternating current signal and that outputs a first output signal and a second output signal to the first and second heat tracing cables, respectively.

18. The heating system of claim 17, further comprising:

a second walkway cassette having a third heat tracing cable, wherein the third heat tracing cable is powered in series with the first heat tracing cable, such that a signal being applied to power the first heat tracing cable causes both the first and third heat tracing cables to heat the walkway cassette and the second walkway cassettes.

19. The heating system of claim 13, wherein the temperature control element is arranged to be exposed to substantially similar environmental conditions as the walkway cassette.

20. The heating system of claim 13, wherein the first and second heat tracing cables are powered in parallel.

* * * * *